US011885330B2

(12) United States Patent
Yasui et al.

(10) Patent No.: US 11,885,330 B2
(45) Date of Patent: Jan. 30, 2024

(54) TWO-CYLINDER ROTARY COMPRESSOR WITH MUFFLERS

(71) Applicant: FUJITSU GENERAL LIMITED, Kanagawa (JP)

(72) Inventors: Tatsuya Yasui, Kanagawa (JP); Kenshi Ueda, Kanagawa (JP); Naoto Tada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/801,370

(22) PCT Filed: Sep. 30, 2020

(86) PCT No.: PCT/JP2020/037357
§ 371 (c)(1),
(2) Date: Aug. 22, 2022

(87) PCT Pub. No.: WO2021/171677
PCT Pub. Date: Sep. 2, 2021

(65) Prior Publication Data

US 2023/0080650 A1 Mar. 16, 2023

(30) Foreign Application Priority Data

Feb. 26, 2020 (JP) ..... 2020-030840

(51) Int. Cl.
*F04C 18/356* (2006.01)
*F04C 29/06* (2006.01)
*F04C 23/00* (2006.01)

(52) U.S. Cl.
CPC ..... *F04C 18/3564* (2013.01); *F04C 23/001* (2013.01); *F04C 29/065* (2013.01); *F04C 29/068* (2013.01); *F04C 2240/30* (2013.01)

(58) Field of Classification Search
CPC .. F04C 18/3564; F04C 23/001; F04C 29/065; F04C 29/068; F04C 2240/30
See application file for complete search history.

(56) References Cited

U.S. PATENT DOCUMENTS 9,695,819 B2 * 7/2017 Ogata ..... F04C 18/3564
11,078,911 B2 * 8/2021 Ueda ..... F04C 18/3564
(Continued)

FOREIGN PATENT DOCUMENTS

CN 101166903 A 4/2008
CN 103032326 A 10/2013
(Continued)

OTHER PUBLICATIONS

International Search Report issued in INTERNATIONAL Application No. PCT/JP2020/037357, dated Nov. 10, 2020, along with an English translation thereof.
(Continued)

*Primary Examiner* — Mary Davis
(74) *Attorney, Agent, or Firm* — Greenblum & Bernstein, P.L.C.

(57) ABSTRACT

A lower end plate cover is provided with a bulging portion. In a circumferential direction of a rotary shaft, a plurality of bolt holes includes a first bolt hole arranged between a distal end portion and a proximal end portion of the lower discharge valve, a second bolt hole arranged in a position adjacent to the first bolt hole on a side close to a lower vane groove with respect to the first bolt hole, and a third bolt hole arranged in a position adjacent to the first bolt hole on a side away from the lower vane groove with respect to the first bolt hole. When the bulging portion is divided into a first bulging portion and a second bulging portion using a first straight line, the first bulging portion is larger than the second bulging portion.

8 Claims, 6 Drawing Sheets

(56) References Cited

U.S. PATENT DOCUMENTS

| | | | | |
|---|---|---|---|---|
| 11,384,760 | B2 * | 7/2022 | Inoue | F01C 21/108 |
| 2009/0074600 | A1 | 3/2009 | Shimizu et al. | |
| 2009/0277216 | A1 | 11/2009 | Shimizu et al. | |
| 2013/0084202 | A1 | 4/2013 | Takahashi et al. | |
| 2017/0335848 | A1 | 11/2017 | Morozumi et al. | |
| 2020/0166032 | A1 | 5/2020 | Inoue et al. | |
| 2020/0208634 | A1 | 7/2020 | Ueda et al. | |

FOREIGN PATENT DOCUMENTS

| | | | |
|---|---|---|---|
| JP | 2016-118142 | A | 6/2016 |
| JP | 6128194 | B2 | 5/2017 |
| JP | 2017-115606 | A | 6/2017 |
| JP | 2019-023449 | A | 2/2019 |
| JP | 2019-039354 | A | 3/2019 |
| WO | WO2018/088409 | A1 | 5/2018 |

OTHER PUBLICATIONS

Notification to Grant in counterpart Chinese patent application No. 202080097593.1 dated Sep. 3, 2023, along with English translation.

* cited by examiner (B-B)

(A-A)

TWO-CYLINDER ROTARY COMPRESSOR WITH MUFFLERS

FIELD

The present invention relates to a rotary compressor.

BACKGROUND

For example, in an air handling unit or a refrigeration apparatus, a two-cylinder rotary compressor is used to compress a refrigerant. The two-cylinder rotary compressor is configured such that, in order to reduce variation in torque of a rotary shaft per rotation as much as possible, in general, two cylinders that are arranged vertically perform processes of suction, compression, and discharge at phases different from each other by 180 degrees. Except for peculiar operation conditions on the start, as for operations of an air handling unit at a normal outdoor temperature and a room temperature, a discharge process by one of the cylinders is about ⅓ of one rotation. Accordingly, ⅓ of one rotation is the process of discharge (the process in which a discharge valve is open) of the one of the cylinders, another ⅓ is a discharge process of the other cylinder, and the remaining ⅓ is a process in which both discharge valves are closed.

When the discharge valves of both the two upper and lower cylinders are closed and there is no flow of the refrigerant to be discharged from the compressor, both an upper muffler chamber (also referred to as upper end plate cover chamber below) and a lower muffler chamber (also referred to as lower end plate cover chamber below) have pressures that are the same as the pressures in a compressor housing that is outside the upper muffler chamber. In the discharge process of one of the cylinders, the pressure of the compressor chamber on the most upstream side in the flow of the refrigerant in an area where the refrigerant is compressed to a high pressure, is the highest and the following order is as follows: both the upper muffler chamber and the lower muffler chambers, and the inside of the compressor housing outside the upper muffler chamber. Accordingly, right after the discharge valve of the upper cylinder opens, the pressure in the upper muffler chamber is higher than the pressure in the compressor housing outside the upper muffler chamber and the lower muffler chamber. Therefore, in the next moment, a flow of the refrigerant from the upper muffler chamber to the inside of the compressor housing outside the upper muffler chamber and a flow of the refrigerant back through a refrigerant path hole, which connects the upper muffler chamber and the lower muffler chamber, from the upper muffler chamber to the lower muffler chamber occur. As described above, what is called a refrigerant back flow phenomenon in which a phenomenon in which part of the refrigerant, which is compressed by the upper cylinder to a high pressure and is discharged to the upper muffler chamber, flows back through the refrigerant path hole into the lower muffler chamber, occurs.

The flow from the upper muffler chamber into the compressor housing, which is outside the upper muffler chamber, is the original flow; however, the refrigerant, having flown from the upper muffler chamber to the lower muffler chamber, flows into the compressor housing outside the upper muffler chamber through the refrigerant path hole and the upper muffler chamber again after the discharge process by the upper cylinder ends, and this flow is originally an unnecessary flow and results in an energy loss and thus lowers efficiency of the rotary compressor. On the other hand, when the lower end plate and the lower muffler chamber, which is formed in the lower end plate, are excessively increased in order to increase the effect of reducing noise, the space, in which the refrigerant that flows back from the upper muffler chamber flows into the lower muffler chamber, increases and lowering of efficiency of the rotary compressor tends to increase.

CITATION LIST

Patent Literature

Patent Literature 1: Japanese Laid-open Patent Publication No. 2016-118142

SUMMARY

Technical Problem

A technique of, in order to suppress efficiency of the rotary compressor from lowering, forming the lower end plate cover into a flat shape or forming a bulging portion in only part of the lower end plate cover, and thereby reducing the lower muffler chamber and suppressing the efficiency of the rotary compressor from lowering, is known.

When the volume of the bulging portion of the lower end plate cover is reduced excessively, the lower muffler chamber is too small and therefore the refrigerant, which is compressed in the lower compression chamber of the lower cylinder, flows early from the lower muffler chamber into the upper muffler chamber through the refrigerant path hole. For this reason, the pressure pulsation in the lower muffler chamber increases, and the effect of sound attenuation by the lower muffler chamber is not obtained appropriately and, as a result, there is a problem in that the amplitude of vibration occurring in the lower end plate cover increases.

On the other hand, when the volume of the bulging portion of the lower end plate cover is increased, the pressure pulsation in the lower muffler chamber reduces, and the amplitude of vibrations occurring in the rotary compressor in association with the pressure pulsation is suppressed from increasing. In this case, however, because the space, into which the refrigerant having flown back from the upper muffler chamber to the lower muffler chamber through the refrigerant path hole flows, increases, lowering of efficiency of the rotary compressor is caused.

It is thus difficult to realize both improvement in efficiency of the rotary compressor and suppression of vibration of the rotary compressor.

The disclosed technique was made in view of the above-described circumstances, and an object of the technique is to provide a rotary compressor capable of increasing efficiency and suppressing compression pulsation in a lower end plate cover chamber (lower muffler chamber).

Solution to Problem

According to an aspect of an embodiments in the present application, a rotary compressor includes: a compressor housing that is cylindrical and in which a refrigerant discharge unit is provided in an upper part and a refrigerant suction unit is provided in a lower part, the compressor housing being sealed; a compression unit that is arranged in the compressor housing, that compresses a refrigerant, which is sucked from the suction unit, and that discharges the refrigerant from the discharge unit; and a motor that is arranged in the compressor housing and that drives the compression unit, the compression unit including an upper cylinder, which is annular, and a lower cylinder, which is annular; an upper end plate that closes an upper side of the upper cylinder; a lower end plate that closes a lower side of the lower cylinder; an intermediate partition plate that is arranged between the upper cylinder and the lower cylinder and that closes a lower side of the upper cylinder and an upper side of the lower cylinder; a rotary shaft that is supported by a main bearing, provided in the upper end plate, and a sub bearing, provided in the lower end plate, and that is rotated by the motor; an upper eccentricity unit and a lower eccentricity unit that are provided in the rotary shaft with a phase difference; an upper piston that is provided in the upper eccentricity unit, that revolves along an inner circumferential surface of the upper cylinder, and that forms an upper cylinder chamber in the upper cylinder; a lower piston that is provided in the lower eccentricity unit, that revolves along an inner circumferential surface of the lower cylinder, and that forms a lower cylinder chamber in the lower cylinder; an upper vane that protrudes from an upper vane groove, provided in the upper cylinder, into the upper cylinder chamber, that makes contact with the upper piston, and that divides the upper cylinder chamber into an upper suction chamber and an upper compression chamber; a lower vane that protrudes from a lower vane groove, provided in the lower cylinder, into the lower cylinder chamber, that makes contact with the lower piston, and that divides the lower cylinder chamber into a lower suction chamber and a lower compression chamber; an upper end plate cover that covers the upper end plate, that forms an upper end plate cover chamber between the upper end plate cover and the upper end plate, and that has an upper end cover discharge hole connecting the upper end plate cover chamber and inside of the compressor housing; a lower end plate cover that covers the lower end plate and that forms a lower end plate cover chamber between the lower end plate cover and the lower end plate; an upper discharge hole that is provided in the upper end plate and that connects the upper compression chamber and the upper end plate cover chamber; a lower discharge hole that is provided in the lower end plate and that connects the lower compression chamber and the lower end plate cover chamber; a refrigerant path hole that penetrates the lower end board, the lower cylinder, the intermediate partition plate, the upper end plate, and the upper cylinder and that connects the lower end plate cover chamber and the upper end plate cover chamber; a plurality of bolt holes that penetrate the lower end plate cover and that are provided on a same circumference in an outer edge part of the lower end plate cover; and a plurality of through bolts that are inserted into the bolt holes from a side of the lower end plate cover and that fastens the lower end plate cover to the lower cylinder, wherein the lower end plate includes a lower discharge valve in a form of a reed valve whose proximal end portion is fixed to the lower end plate and whose proximal end portion opens and closes the lower discharge hole; a lower discharge valve housing concave portion that is extended in a form of a groove from the lower discharge hole and in which the lower discharge valve is housed; and a lower discharge chamber concave portion that is formed such that the lower discharge chamber concave portion overlaps the discharge valve housing concave portion on a side of the lower discharge hole and that connects to the refrigerant path hole, the lower end plate cover is formed into a plate shape and is provided with a bulging portion having a portion opposed to the lower discharge hole, the lower end plate cover chamber is formed of the lower discharge valve housing concave portion, the lower discharge chamber concave portion, and the bulging portion, in a circumferential direction of the rotary shaft, the bolt holes includes a first bolt hole, which is arranged between the distal end portion and the proximal end portion of the lower discharge valve, a second bolt hole, which is arranged in a position adjacent to the first bolt hole on a side close to the lower vane groove with respect to the first bolt hole, and a third bolt hole, which is arranged in a position adjacent to the first bolt hole on a side away from the lower vane groove with respect to the first bolt hole, and when the bulging portion of the lower end plate cover is divided into a first bulging portion, which is positioned on a side of the second bolt hole, and a second bulging portion, which is positioned on a side of the third bolt hole, on a plane orthogonal to the axial direction of the rotary shaft, using a first straight line connecting a center of the rotary shaft and a center of the first bolt hole, the first bulging portion is larger than the second bulging portion.

Advantageous Effects of Invention

According to a mode of the rotary compressor disclosed by the present application, it is possible to increase efficiency of the rotary compressor and suppress pressure pulsation in the lower end plate cover chamber.

DESCRIPTION OF EMBODIMENTS

An embodiment of a rotary compressor, disclosed by the present application, will be described in detail below based on the drawings. Note that the embodiment does not limit the rotary compressor disclosed by the present application.

Embodiment (Configuration of Rotary Compressor)

Figure 1:
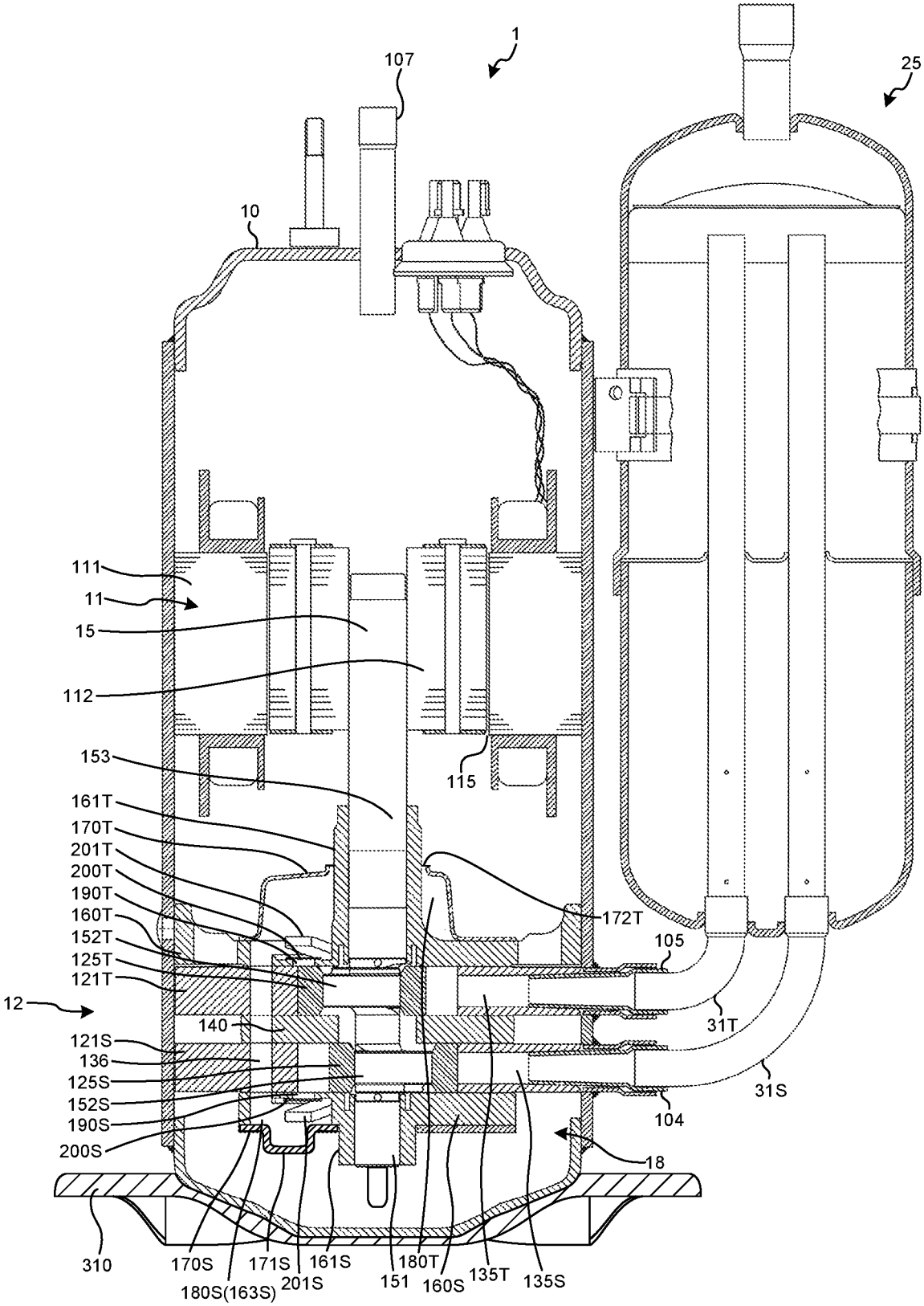
FIG. 1 is a longitudinal cross-sectional view of a rotary compressor of an embodiment.
Figure 2:
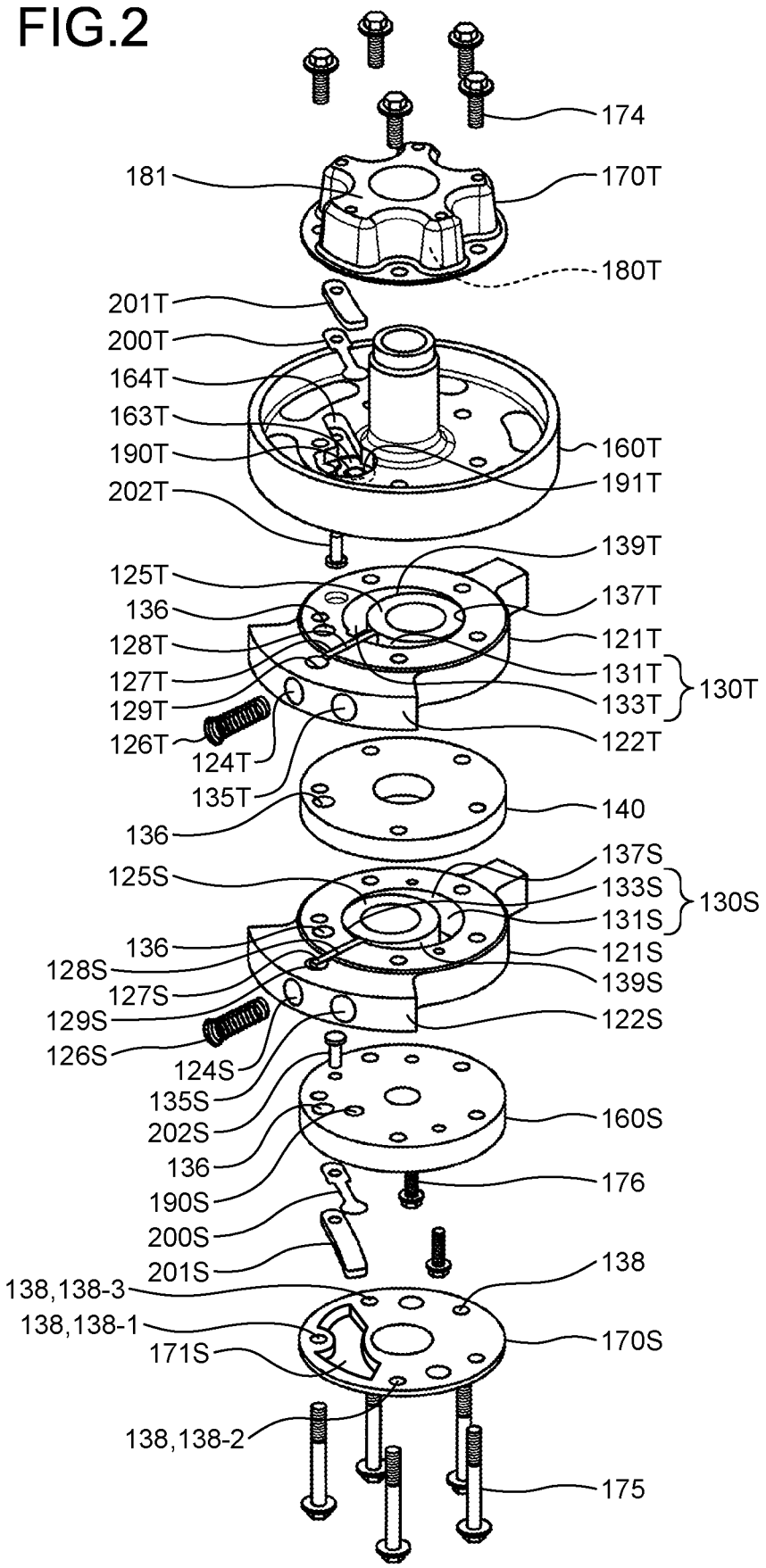
FIG. 2 is an exploded perspective view illustrating a compression unit of the rotary compressor of the embodiment.
Figure 3:
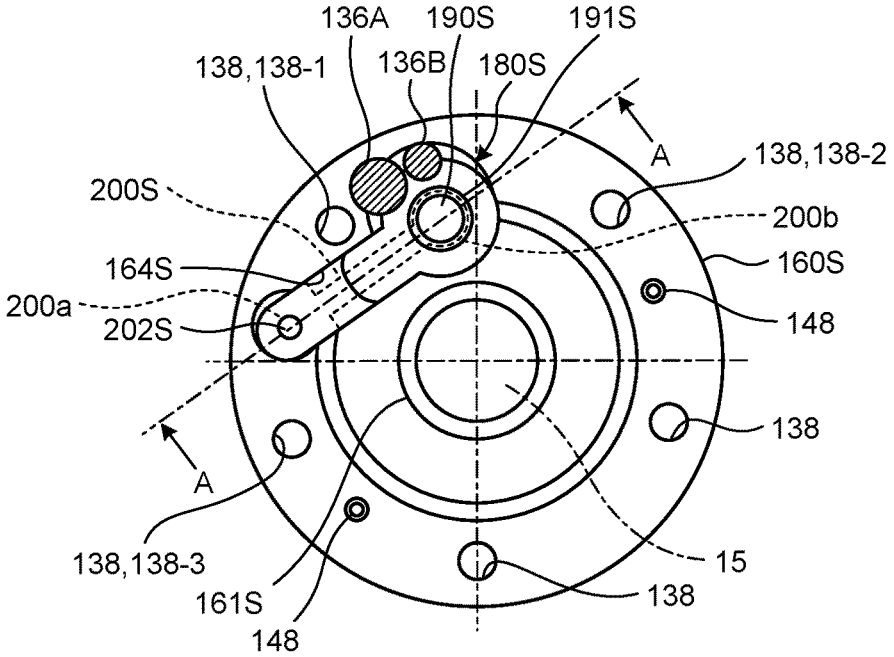
FIG. 3 is a plane view of a lower end plate of the rotary compressor of the embodiment, viewed from the bottom.

FIG. 1 is a longitudinal cross-sectional view of a rotary compressor of an embodiment. FIG. 2 is an exploded perspective view illustrating a compression unit of the rotary compressor of the embodiment. FIG. 3 is a plane view of a lower end plate of the rotary compressor of the embodiment, viewed from the bottom.

As illustrated in FIG. 1, a rotary compressor 1 includes a compression unit 12 that is arranged in a lower part in a compressor housing 10, which is vertical and cylindrical and which is sealed, a motor 11 that drives the compression unit 12 via a rotary shaft 15 and that is arranged in an upper part in the compressor housing 10, and a vertical and cylindrical accumulator 25 that is fixed to an outer circumference of the compressor housing 10 and that is sealed.

The compressor housing 10 includes an upper suction pipe 105 and a lower suction pipe 104, which suck a refrigerant, and the upper suction pipe 105 and the lower suction pipe are provided in a side surface lower part of the compressor housing 10. The accumulator 25 is connected to an upper cylinder chamber 130T (refer to FIG. 2) of an upper cylinder 121T via the upper suction pipe 105 serving as a suction unit and an accumulator upper curve pipe 31T, and is connected to a lower cylinder chamber 130S (refer to FIG. 2) of a lower cylinder 121S via the lower suction pipe 104 serving as the suction unit and an accumulator lower curve pipe 31S. In the present embodiment, in a circumferential direction of the compressor housing 10, the positions of the upper suction pipe 105 and the lower suction pipe 104 overlap, and are positioned in the same position.

The motor 11 includes a stator 111, which is arranged outside, and a rotor 112, which is arranged inside. The stator 111 is fixed to an inner circumferential surface of the compressor housing 10 by shrink fit or welding. The rotor 112 is fixed to the rotary shaft 15 by shrink fit.

In the rotary shaft 15, a sub shaft part 151 under a lower eccentricity unit 152S is rotatably supported on a sub bearing 161S, which is provided in a lower end plate 160S, and a main shaft part 153 above an upper eccentricity unit 152T is rotatably supported on a main bearing 161T, which is provided in an upper end plate 160T. The rotary shaft 15 is provided with the upper eccentricity unit 152T and the lower eccentricity unit 152S with a phase difference of 180 degrees, an upper piston 125T is supported on the upper eccentricity unit 152T, and a lower piston 125S is supported on the lower eccentricity unit 152S. Thus, the rotary shaft 15 is rotatably supported on the whole compression unit 12, and the rotation causes an outer circumferential surface 139T of the upper piston 125T to have a revolution motion along an inner circumferential surface 137T of the upper cylinder 121T, and causes an outer circumferential surface 139S of the lower piston 125S to have a revolution motion along an inner circumferential surface 137S of the lower cylinder 121S.

In the compressor housing 10, a lubricant oil 18 for ensuring lubrication between sliding parts, such as the upper cylinder 121T and the upper piston 125T, and the lower cylinder 121S and the lower piston 125S, and for sealing an upper compression chamber 133T (refer to FIG. 2) and a lower compression chamber 133S (refer to FIG. 2) in only an amount in which the compression unit 12 is almost immersed, is enclosed. To a lower side of the compressor housing 10, an attachment leg 310 (refer to FIG. 1), with which a plurality of elastic support members (not illustrated in the drawing) that support the whole rotary compressor 1 are engaged, is fixed.

As illustrated in FIG. 1, the compression unit 12 compresses the refrigerant, which is sucked from the upper suction pipe 105 and the lower suction pipe 104, and discharges the refrigerant from a discharge pipe 107 to be described below. As illustrated in FIG. 2, the compression unit 12 is configured by layering, from the top, an upper end plate cover 170T having a bulging portion 181 in which a hollow space is formed, the upper end plate 160T, the upper cylinder 121T that is annular, an intermediate partition plate 140, the lower cylinder 121S that is annular, the lower end plate 160S, and a lower end plate cover 170S that is flat. The whole compression unit 12 is fixed vertically with a plurality of through bolts 174 and 175 and auxiliary bolts 176 that are arranged on a same circumference.

In the upper cylinder 121T, the inner circumferential surface 137T, which is cylindrical, is formed. The upper piston 125T, whose outer diameter is smaller than the inner diameter of the inner circumferential surface 137T of the upper cylinder 121T, is arranged on an inner side with respect to the inner circumferential surface 137T of the upper cylinder 121T, and the upper compression chamber 133T for sucking, compressing, and discharging the refrigerant, is formed between the inner circumferential surface 137T of the upper cylinder 121T and the outer circumferential surface 139T of the upper piston 125T. In the lower cylinder 121S, the inner circumferential surface 137S, which is cylindrical, is formed. The lower piston 125S, whose outer diameter is smaller than the inner diameter of the inner circumferential surface 137S of the lower cylinder 121S, is arranged on an inner side with respect to the inner circumferential surface 137S of the lower cylinder 121S, and the lower compression chamber 133S for sucking, compressing, and discharging the refrigerant, is formed between the inner circumferential surface 137S of the lower cylinder 121S and the outer circumferential surface 139S of the lower piston 125S.

As illustrated in FIG. 2, the upper cylinder 121T has an upper side protrusion 122T that projects on an outer circumferential side in a radial direction of the inner circumferential surface 137T, which is cylindrical, from an outer circumferential part. The upper side protrusion 122T is provided with an upper vane groove 128T that extends outward radially from the upper cylinder chamber 130T. In the upper vane groove 128T, an upper vane 127T is slidably arranged. The lower cylinder 121S has a lower side protrusion 122S that projects on an outer circumferential side in a radial direction of the inner circumferential surface 137S, which is cylindrical, from an outer circumferential part. The lower side protrusion 122S is provided with a lower vane groove 128S that extends outward radially from the lower cylinder chamber 130S. In the lower vane groove 128S, a lower vane 127S is slidably arranged.

The upper side protrusion 122T is formed along a circumferential direction of the inner circumferential surface 137T of the upper cylinder 121T over a given protrusion area. The lower side protrusion 122S is formed along a circumferential direction of the inner circumferential surface 137S of the lower cylinder 121S over a given protrusion area. The upper side protrusion 122T and the lower side protrusion 122S are used as attachment holders for fixation to a processing jig when the upper cylinder 121T and the lower cylinder 121S are processed. Because of fixation of the upper side protrusion 122T and the lower side protrusion 122S to the processing jig, the upper cylinder 121T and the lower cylinder 121S are positioned in given positions.

In the upper side protrusion 122T, an upper spring hole 124T is provided in a position overlapping the upper vane groove 128T and in a depth not penetrating the upper cylinder chamber 130T from an outer side surface. An upper spring 126T is arranged in the upper spring hole 124T. In the lower side protrusion 122S, a lower spring hole 124S is provided in a position overlapping the lower vane groove 128S and in a depth not penetrating the lower cylinder chamber 130S from an outer side surface. A lower spring 126S is arranged in the lower spring hole 124S.

In the upper cylinder 121T, an upper pressure introduction path 129T, which connects a radial-direction outer side of the upper vane groove 128T and the inside of the compressor housing 10 via an opening and into which the compressed refrigerant in the compressor housing 10 is introduced to apply a back pressure to the upper vane 127T by the pressure of the refrigerant, is formed. In the lower cylinder 121S, a lower pressure introduction path 129S, which connects a radial-direction outer side of the lower vane groove 128S and the inside of the compressor housing 10 and into which the compressed refrigerant in the compressor housing 10 is introduced to apply a back pressure to the lower vane 127S by the pressure of the refrigerant, is formed.

The upper side protrusion 122T of the upper cylinder 121T is provided with an upper suction hole 135T, in which the upper suction pipe 105 is fitted. The lower side protrusion 122S of the lower cylinder 121S is provided with a lower suction hole 135S, in which the lower suction pipe 104 is fitted. In the upper cylinder 121T, the upper suction hole 135T extends along a radial direction of the rotary shaft 15, and the upper suction hole 135T is connected to the upper cylinder chamber 130T. In the lower cylinder 121S, the lower suction hole 135S extends along a radial direction of the rotary shaft 15, and the lower suction hole 135S is connected to the lower cylinder chamber 130S.

As illustrated in FIG. 2, in the upper cylinder chamber 130T, an upper side is closed with the upper end plate 160T and a lower side is closed with the intermediate partition plate 140. An upper side of the lower cylinder chamber 130S is closed with the intermediate partition plate 140, and a lower side is closed with the lower end plate 160S.

The upper vane 127T is pressed by the upper spring 126T and makes contact with the outer circumferential surface 139T of the upper piston 125T, and accordingly the upper cylinder chamber 130T is divided into an upper suction chamber 131T, which is connected to the upper suction hole 135T, and the upper compression chamber 133T, which is connected to an upper discharge hole 190T that is provided in the upper end plate 160T. The lower vane 127S is pressed by the lower spring 126S and makes contact with the outer circumferential surface 139S of the lower piston 125S, and accordingly the lower cylinder chamber 130S is divided into a lower suction chamber 131S, which is connected to the lower suction hole 135S, and the lower compression chamber 133S, which is connected to a lower discharge hole 190S that is provided in the lower end plate 160S.

The upper discharge hole 190T is provided in the vicinity of the upper vane groove 128T, and the lower discharge hole 190S is provided in the vicinity of the lower vane groove 128S. The refrigerant, which is compressed in the upper compression chamber 133T, is discharged from the upper compression chamber 133T via the upper discharge hole 190T. The refrigerant, which is compressed in the lower compression chamber 133S, is discharged from the lower compression chamber 133S via the lower discharge hole 190S.

As illustrated in FIG. 2, the upper end plate 160T is provided with the upper discharge hole 190T that penetrates the upper end plate 160T and that is connected to the upper compression chamber 133T of the upper cylinder 121T. On an outlet side of the upper discharge hole 190T, an upper valve seat 191T is formed around the upper discharge hole 190T. On an upper side of the upper end plate 160T (the side of the upper end plate cover 170T), an upper discharge valve housing concave portion 164T, which extends in a form of a groove from the position of the upper discharge hole 190T to an outer circumference of the upper end plate 160T, is formed.

A whole upper discharge valve 200T in a form of a reed valve and a whole upper discharge valve cap 201T, which regulates opening of the upper discharge valve 200T, are housed in the upper discharge valve housing concave portion 164T. In the upper discharge valve 200T, a proximal end portion is fixed in the upper discharge valve housing concave portion 164T with an upper rivet 202T, and a distal end portion opens and closes the upper discharge hole 190T. In the upper discharge valve cap 201T, a proximal end portion is overlapped with the upper discharge valve 200T and is fixed in the upper discharge valve housing concave portion 164T with the upper rivet 202T, and a distal end portion curves (warps) in a direction in which the upper discharge valve 200T opens and regulates opening of the upper discharge valve 200T. The upper discharge valve housing concave portion 164T is formed such that its width is slightly larger than the widths of the upper discharge valve 200T and the upper discharge valve cap 201T, houses the upper discharge valve 200T and the upper discharge valve cap 201T, and positions the upper discharge valve 200T and the upper discharge valve cap 201T in given positions.

As illustrated in FIG. 3, the lower end plate 160S is provided with the lower discharge hole 190S that penetrates the lower end plate 160S and that is connected to the lower compression chamber 133S of the lower cylinder 121S. On an outlet side of the lower discharge hole 190S, a lower valve seat 191S, which is annular, is formed around the lower discharge hole 190S. The lower valve seat 191S is formed with an elevation with respect to a bottom surface of a lower discharge chamber concave portion 163S. On a lower side of the lower end plate 160S (the side of the lower end plate cover 170S), a lower discharge valve housing concave portion 164S, which extends in a form of a groove from the position of the lower discharge hole 190S to an outer circumference of the lower end plate 160S, is formed.

Figure 6:
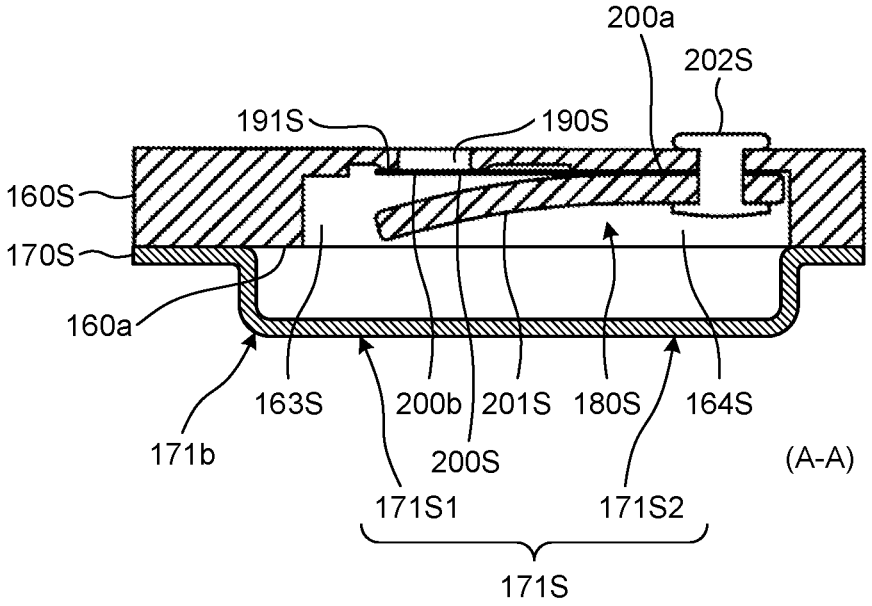
FIG. 6 is a cross-sectional view illustrating a relevant part of the rotary compressor of the embodiment, taken along the line A-A in FIG. 3.

A whole lower discharge valve 200S in a form of a reed valve and a whole lower discharge valve cap 201S, which regulates opening of the lower discharge valve 200S, are housed in the lower discharge valve housing concave portion 164S (FIG. 6). In the lower discharge valve 200S, a proximal end portion 200*a* is fixed in the lower discharge valve housing concave portion 164S with a lower rivet 202S, and a distal end portion 200*b* opens and closes the lower discharge hole 190S (FIG. 6). In the lower discharge valve cap 201S, a proximal end portion is overlapped with the lower discharge valve 200S and is fixed in the lower discharge valve housing concave portion 164S with the lower rivet 202S, and a distal end portion curves (warps) in a direction in which the lower discharge valve 200S opens and regulates opening of the lower discharge valve 200S. The lower discharge valve housing concave portion 164S is formed such that the width in the radial direction of the rotary shaft 15 is slightly larger than the widths of the lower discharge valve 200S and the lower discharge valve cap 201S, houses the lower discharge valve 200S and the lower discharge valve cap 201S, and positions the lower discharge valve 200S and the lower discharge valve cap 201S in given positions.

An upper end plate cover chamber 180T is formed between the upper end plate 160T and the upper end plate cover 170T having the bulging portion 181 that are fixed tightly to each other. A lower end plate cover chamber 180S (refer to FIG. 3) is formed between the lower end plate 160S and the flat lower end plate cover 170S that are fixed tightly to each other. Two refrigerant path holes 136A and 136B (the slashed parts in FIG. 3) that penetrate the lower end plate 160S, the lower cylinder 121S, the intermediate partition plate 140, the upper end plate 160T, and the upper cylinder 121T, and that connect the lower end plate cover chamber 180S and the upper end plate cover chamber 180T, are provided.

As illustrated in FIG. 3, the refrigerant path holes 136A and 136B are formed into circular shapes and are arranged adjacently along an outer circumferential surface of the lower end plate 160S. The refrigerant path hole 136A is formed such that its diameter is larger than that of the refrigerant path hole 136B and is arranged on the side of a proximal end portion of the lower discharge valve 200S (the side of the lower rivet 202S) with respect to the refrigerant path hole 136B. The refrigerant path hole 136A is arranged such that the refrigerant path hole 136A partly overlaps an inner circumferential surface of the lower discharge chamber concave portion 163S. The refrigerant path hole 136B makes contact with the inner circumferential surface of the lower discharge chamber concave portion 163S and is arranged in the lower discharge chamber concave portion 163S. Note that the present embodiment includes the two refrigerant path holes 136A and 136B; however, the number of refrigerant path holes is not limited to two.

As illustrated in FIG. 3, the lower discharge chamber concave portion 163S is connected to the lower discharge valve housing concave portion 164S. The lower discharge chamber concave portion 163S is formed in the same depth as that of the lower discharge valve housing concave portion 164S such that the lower discharge chamber concave portion 163S partly overlaps the lower discharge valve housing concave portion 164S on the side of the lower discharge hole 190S. The lower discharge valve housing concave portion 164S on the side of the lower discharge hole 190S is housed in the lower discharge chamber concave portion 163S. A refrigerant path hole 136 at least partly overlaps the lower discharge chamber concave portion 163S and is arranged in a position connecting to the lower discharge chamber concave portion 163S.

On a lower surface of the lower end plate 160S (surface of contact with the lower end plate cover 170S), a plurality of bolt holes 138 (FIG. 3), through which the through bolts 175 are caused to penetrate, are provided in an area excluding the area where the lower discharge chamber concave portion 163S and the lower discharge valve housing concave portion 164S are formed. As illustrated in FIG. 3, the lower surface of the lower end plate 160S is provided with two auxiliary bolt holes 148, through which the auxiliary bolts 176 (FIG. 2) are caused to penetrate. The lower end plate 160S is fastened to the lower cylinder 121S with the auxiliary bolts 176 being inserted into the auxiliary bolt holes 148 from the side of the lower end plate 160S.

The refrigerant path hole 136 at least partly overlaps an upper discharge chamber concave portion 163T and is arranged in a position connecting to the upper discharge chamber concave portion 163T. As for the upper discharge chamber concave portion 163T and the upper discharge valve housing concave portion 164T that are formed in the upper end plate 160T, although detailed illustration in the drawings is omitted, they are formed into shapes similar to those of the lower discharge chamber concave portion 163S and the lower discharge valve housing concave portion 164S. The upper end plate cover chamber 180T is formed of the bulging portion 181 that is dome-like, the upper discharge chamber concave portion 163T, and the upper discharge valve housing concave portion 164T.

A flow of the refrigerant according to rotation of the rotary shaft 15, will be described below. In the upper cylinder chamber 130T, because of the rotation of the rotary shaft 15, the upper piston 125T, which is fitted in the upper eccentricity unit 152T of the rotary shaft 15, revolves along the inner circumferential surface 137T of the upper cylinder 121T, and accordingly the upper suction chamber 131T sucks the refrigerant from the upper suction pipe 105 while expanding the capacity and the upper compression chamber 133T compresses the refrigerant while reducing the capacity and, when the pressure of the compressed refrigerant is higher than the pressure of the upper end plate cover chamber 180T outside the upper discharge valve 200T, the upper discharge valve 200T opens and the refrigerant is discharged from the upper compression chamber 133T to the upper end plate cover chamber 180T. The refrigerant, which is discharged to the upper end plate cover chamber 180T, is discharged into the compressor housing 10 from an upper end plate cover discharge hole 172T (refer to FIG. 1), which is provided in the upper end plate cover 170T.

In the lower cylinder chamber 130S, because of the rotation of the rotary shaft 15, the lower piston 125S, which is fitted in the lower eccentricity unit 152S of the rotary shaft 15, revolves along the inner circumferential surface 137S of the lower cylinder 121S, and accordingly the lower suction chamber 131S sucks the refrigerant from the lower suction pipe 104 while expanding the capacity and the lower compression chamber 133S compresses the refrigerant while reducing the capacity and, when the pressure of the compressed refrigerant is higher than the pressure of the lower end plate cover chamber 180S outside the lower discharge valve 200S, the lower discharge valve 200S opens and the refrigerant is discharged from the lower compression chamber 133S to the lower end plate cover chamber 180S. The refrigerant, which is discharged to the lower end plate cover chamber 180S, is discharged into the compressor housing 10 from the upper end plate cover discharge hole 172T, which is provided in the upper end plate cover 170T, through the refrigerant path hole 136 and the upper end plate cover chamber 180T.

The refrigerant, which is discharged into the compressor housing 10, is guided to an upper part of the motor 11 through cutouts (not illustrated in the drawing) that are provided on an outer circumference of the stator 111 and that connect vertically, a gap (not illustrated in the drawing) in a winding unit of the stator 111, or a gap 115 (refer to FIG. 1) between the stator 111 and the rotor 112, and is discharged from the discharge pipe 107 that serves as a discharge unit and that is arranged in an upper part of the compressor housing 10.

Characteristic Configuration of Rotary Compressor

Figure 4:
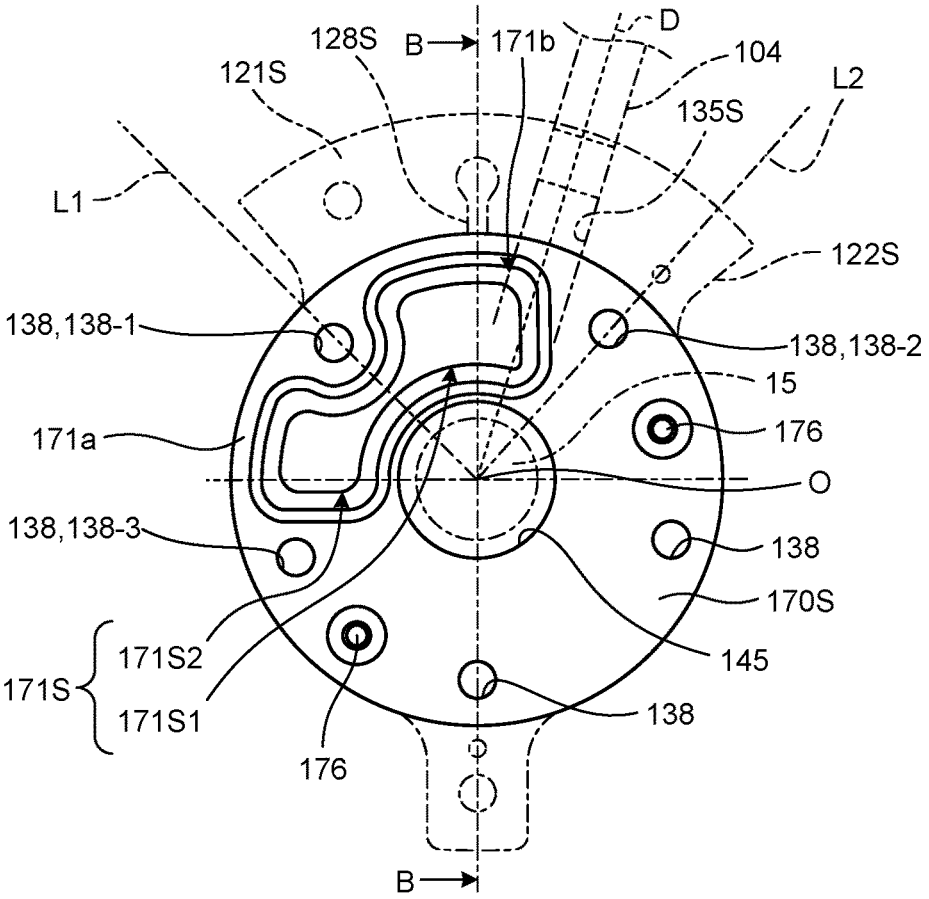
FIG. 4 is a plane view of a lower end plate cover of the rotary compressor of the embodiment, viewed from underneath.
Figure 5:
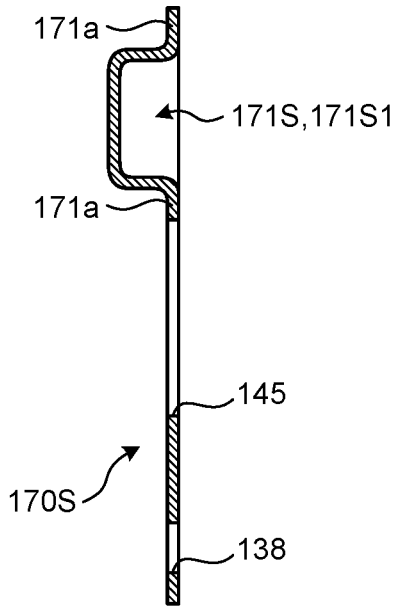
FIG. 5 is a cross-sectional view illustrating the lower end plate cover of the rotary compressor of the embodiment, taken along the line B-B in FIG. 4.
Figure 7:
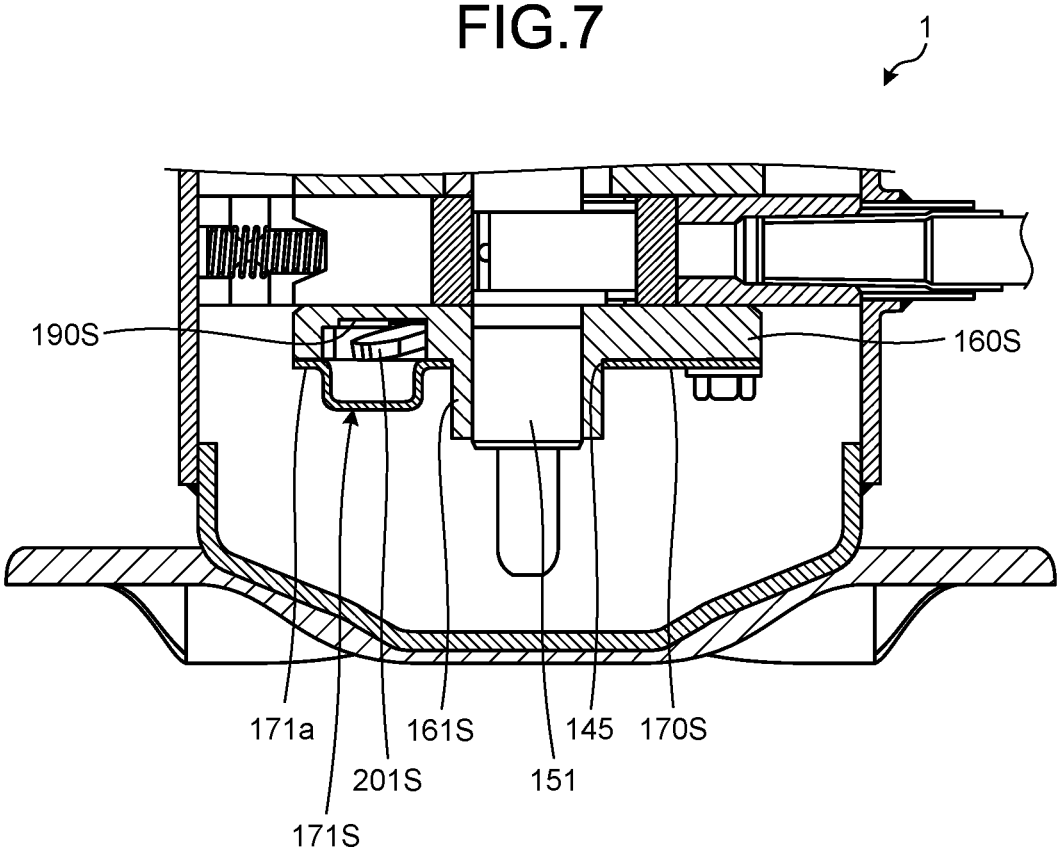
FIG. 7 is a longitudinal cross-sectional view illustrating a relevant part of the rotary compressor of the embodiment.

A characteristic configuration of the rotary compressor 1 according to the embodiment, will be described. Characteristics of the embodiment include a bulging portion 171S of the lower end plate cover 170S. FIG. 4 is a plane view of the lower end plate cover 170S of the rotary compressor 1 of the embodiment, viewed from underneath, that is, viewed from frees outside of the compression unit 12. FIG. 5 is a cross-sectional view illustrating the lower end plate cover 170S of the rotary compressor 1 of the embodiment, taken along the line B-B in FIG. 4. FIG. 6 is a cross-sectional view illustrating a relevant part of the rotary compressor 1 of the embodiment, taken along the line A-A in FIG. 3. FIG. 7 is a longitudinal cross-sectional view illustrating a relevant part of the rotary compressor 1 of the embodiment.

As illustrated in FIG. 4 and FIG. 5, the lower end plate cover 170S is formed into a plate shape and has the bulging portion 171S, which bulges to a lower part of the compression unit 12. The bulging portion 171S forms the lower end plate cover chamber 180S. Accordingly, as illustrated in FIG. 6, the lower end plate cover chamber 180S is formed of the lower discharge chamber concave portion 163S and the lower discharge valve housing concave portion 164S that are provided in the lower end plate 160S, and the bulging portion 171S of the lower end plate cover 170S.

The bulging portion 171S of the lower end plate cover 170S is provided in a position opposed to a distal end portion of the lower discharge valve cap 201S (the position opposed to the lower discharge hole 190S). In other words, the bulging portion 171S has a portion (bottom portion) opposed to the lower discharge hole 190S, and overlaps at least part of the lower discharge hole 190S in a cross-section orthogonal to an axial direction of the rotary shaft 15. A portion, in which the distal end portion of the lower discharge valve cap 201S protrudes from the lower discharge chamber concave portion 163S to the side of the lower end plate cover 170S, may be housed in the bulging portion 171S in the direction of the thickness of the lower end plate 160S.

As illustrated in FIGS. 4 and 5, a through-hole 145, which is circular and into which the sub shaft part 151 is inserted, is formed at the center of the lower end plate cover 170S. In the lower end plate cover 170S, the bolt holes 138 (FIG. 4), through which the through bolts 175 (FIG. 2) are caused to penetrate, are provided in an area excluding the area opposed to the lower discharge chamber concave portion 163S and the lower discharge valve housing concave portion 164S of the lower end plate 160S.

The bolt holes 138 are provided on a same circumference in an outer edge part of the lower end plate cover 170S. The bolt holes 138 are arranged at regular intervals of approximately 70 degrees around a center O of the rotary shaft 15, and includes a first bolt hole 138-1, a second bolt hole 138-2, and a third bolt hole 138-3 to be described below. The through bolts 175 are inserted into the bolt holes 138 from the side of the lower end plate cover 170S, so that the lower end plate cover 170S is fastened to the lower cylinder 121S with the through bolts 175.

As illustrated in FIG. 7, the bulging portion 171S of the lower end plate cover 170S makes contact with the lower surface of the lower end plate 160S throughout a peripheral portion 171*a* of the bulging portion 171S. Thus, because the bulging portion 171S does not have a portion extending over the sub bearing 161S, leakage of the refrigerant from the lower end plate cover chamber 180S due to variation in the shape of the bulging portion 171S and the shape of the sub bearing 161S, is suppressed, and air tightness in the bulging portion 171S is increased.

Bulging Portion of Lower End Plate Cover

Figure 8:
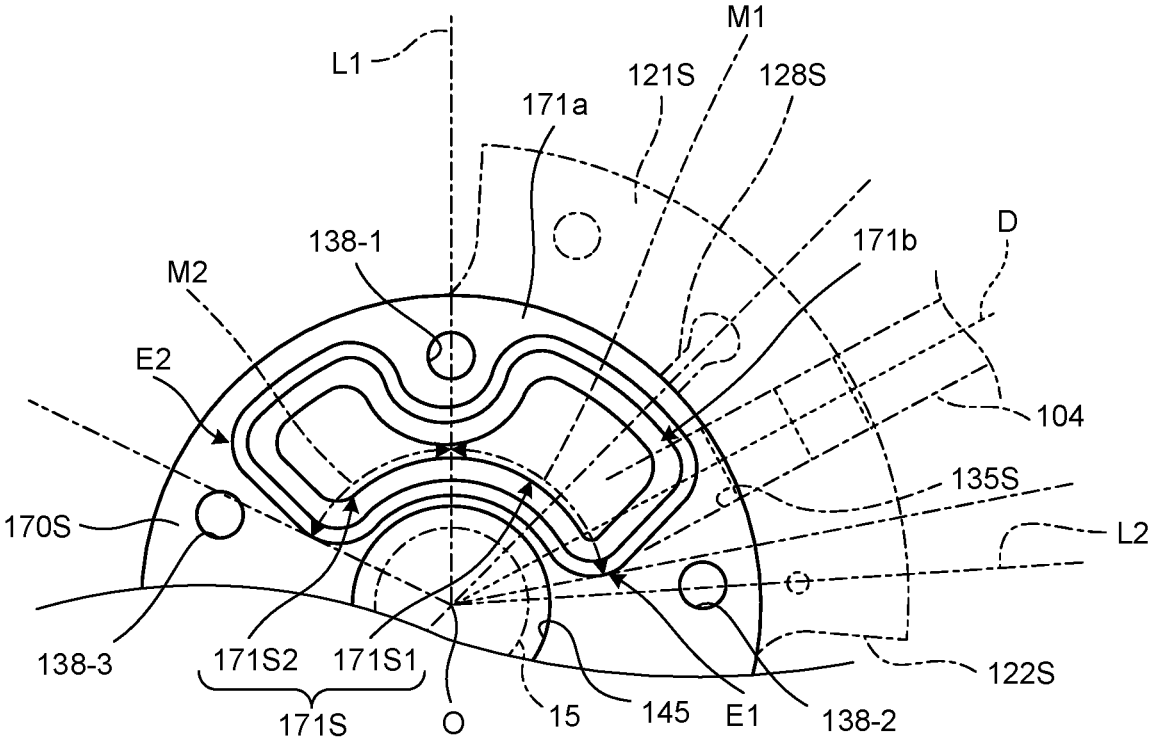
FIG. 8 is a plane view for explaining a bulging portion of the lower end plate cover in the embodiment.

FIG. 8 is a plane view for explaining the bulging portion 171S of the lower end plate cover 170S in the embodiment, and is a plane view of the lower end plate cover 170S viewed up from outside of the compression unit 12.

As illustrated in FIG. 3, FIG. 4 and FIG. 8, the first bolt hole 138-1 among the bolt holes 138 that are provided in the lower end plate cover 170S, is arranged between the distal end portion 200*b* and the proximal end portion 200*a* of the lower discharge valve 200S (FIG. 3) in a circumferential direction of the rotary shaft 15. The second bolt hole 138-2 is arranged in a position adjacent to the first bolt hole 138-1 on a side close to the lower vane groove 128S with respect to the first bolt hole 138-1 in the circumferential direction of the rotary shaft 15. The third bolt hole 138-3 is arranged in a position adjacent to the first bolt hole 138-1 on a side away from the lower vane groove 128S with respect to the first bolt hole 138-1.

As illustrated in FIG. 4 and FIG. 8, when the bulging portion 171S of the lower end plate cover 170S is divided into a first bulging portion 171S1, which is positioned on the side of the second bolt hole 138-2, and a second bulging portion 171S2, which is positioned on the side of the third bolt hole 138-3, on a plane orthogonal to the axial direction of the rotary shaft 15, using a first straight line L1 connecting the center O of the rotary shaft 15 and the center of the first bolt hole 138-1 as a border, the first bulging portion 171S1 is larger than the second bulging portion 171S2.

As illustrated in FIG. 8, an inner circumferential side length M1 of the first bulging portion 171S1, extending along the circumferential direction of the rotary shaft 15 from the first straight line L1 to an end of the bulging portion 171S on an inner circumferential side, is larger than an inner circumferential side length M2 of the second bulging portion 171S2. The end of the bulging portion 171S on the inner circumferential side refers to the end in the circumferential direction of the rotary shaft 15. The inner circumferential side length M1 of the first bulging portion 171S1 and the inner circumferential side length M2 of the second bulging portion 171S2, are lengths on the same circumference along the circumferential direction of the rotary shaft 15. The first bulging portion 171S1 extends to an area between a center line D of the lower suction hole 135S, passing through the center O of the rotary shaft 15, and a second straight line L2, connecting the center O of the rotary shaft 15 and the center of the second bolt hole 138-2, on the plane orthogonal to the axial direction of the rotary shaft 15.

As illustrated in FIG. 8, in the circumferential direction of the rotary shaft 15, an end E1 of the first bulging portion 171S1 on an inner circumferential side (the side of the through-hole 145) on the side of the second bolt hole 138-2, is extended to the vicinity of the second bolt hole 138-2. Specifically, the end E1 of the first bulging portion 171S1 on the inner circumferential side in the circumferential direction of the rotary shaft 15, is extended to the vicinity of a head (not illustrated in the drawing) of the through bolt 175, which is inserted into the second bolt hole 138-2. Similarly, in the circumferential direction of the rotary shaft 15, an end E2 of the second bulging portion 171S2 on an outer circumferential side (the side of an outer circumference of the lower end plate cover 170S), which is the side of the third bolt hole 138-3, is extended to the vicinity of the third bolt hole 138-3. Specifically, the end E2 of the second bulging portion 171S2 on the outer circumferential side in the circumferential direction of the rotary shaft 15, is extended to the vicinity of a head (not illustrated in the drawing) of the through bolt 175, which is inserted into the third bolt hole 138-3.

On the plane orthogonal to the axial direction of the rotary shaft 15 like that illustrated in FIG. 8, the width of the bulging portion 171S with respect to the radial direction of the rotary shaft 15, is at minimum on the first straight line L1. In other words, the bulging portion 171S is formed into a narrowed shape with respect to the radial direction of the rotary shaft 15 in the vicinity of the first straight line L1, that is, between the first bolt hole 138-1 and the through-hole 145 in order to avoid the first bolt hole 138-1. Specifically, in the bulging portion 171S, in order not to make contact with the head (not illustrated in the drawing) of the through bolt 175, which is inserted into the first bolt hole 138-1, a side wall in a shape of an arc along the head is formed.

As described above, the bulging portion 171S is extended to the side of the second bolt hole 138-2 and is extended in a horizontal direction (the direction orthogonal to the axial direction of the rotary shaft 15) in the compression unit 12. This suppresses the depth of the bulging portion 171S with respect to the vertical direction of the compression unit 12 (the axial direction of the rotary shaft 15) from being deep while increasing the capacity of the bulging portion 171S. Accordingly, lowering of accuracy of processing because of difficulty in processing with the same accuracy of processing as that in the case where the depth of the bulging portion 171S is deep, and lowering of workability of the bulging portion 171S due to an increase of processing steps are prevented. When the depth of the bulging portion 171S is large, there is a problem in that the thickness of the bulging portion 171S is thin and the mechanical strength of the bulging portion 171S lowers.

Spatial Volume of Lower End Plate Cover Chamber

Here, a total volume obtained by summing volumes of the lower discharge chamber concave portion 163S, the lower discharge valve housing concave portion 164S, and the bulging portion 171S is set as A, a total volume obtained by summing volumes that the lower discharge valve 200S, the lower discharge valve cap 201S, and the lower rivet 202S occupy in the lower discharge chamber concave portion 163S and the lower discharge valve housing concave portion 164S is set as B, and a total excluded volume obtained by summing excluded volumes of the upper compression chamber 133T and the lower compression chamber 133S is set as C. The spatial volume (A−B) of the lower end plate cover chamber 180S in the embodiment is between 20% and 40% inclusive of the total excluded volume C.

A spatial volume (A−B) of the lower end plate cover chamber 180S within the aforementioned numerical range makes it possible to reduce noise of the rotary compressor 1. When the volume ratio [(A−B)/C]×100[%] of the spatial volume (A−B) with respect to the total excluded volume C is less than 20%, the spatial volume (A−B) is insufficient, and thus it is not possible to obtain an effect of reducing noise appropriately. When the volume ratio [(A−B)/C]×100 [%] exceeds 40%, the spatial volume (A−B) is excessive, and thus it is not possible to obtain an effect of reducing noise appropriately and an effect of increasing efficiency of the rotary compressor 1 lowers largely. In other words, only simply increasing the spatial volume (A−B) does not make it possible to reduce the noise level effectively and increase the efficiency of the rotary compressor 1 effectively.

When the lower discharge chamber concave portion 163S and the lower discharge valve housing concave portion 164S of the lower end plate 160S are expanded in order to increase the spatial volume (A-B), there is a limitation by structural parts, such as the bolt holes 138 and the lower discharge hole 190S that are formed in the lower end plate 160S, and it is difficult to ensure a mechanical strength of the lower end plate 160S appropriately. In other words, when the lower discharge chamber concave portion 163S and the lower discharge valve housing concave portion 164S of the lower end plate 160S are expanded, the mechanical strength around the bolt holes 138 in the lower end plate 160S and around the lower discharge hole 190S lowers and therefore it is not preferable. When the lower discharge chamber concave portion 163S of the lower end plate 160S is extended to the side of the second bolt hole 138-2 in order to increase the spatial volume (A-B), because the lower discharge chamber concave portion 163S overlap the lower suction hole 135S of the lower cylinder 121S on the plane orthogonal to the rotary shaft 15, there is a problem in that refrigerant gas, which is sucked into the lower cylinder chamber 130S, is heated by the heat of refrigerant gas in the lower discharge chamber concave portion 4-63-163S, and the efficiency of the rotary compressor 1 lowers.

For this reason, in the embodiment, on the plane orthogonal to the axial direction of the rotary shaft 15, the lower discharge chamber concave portion 163S of the lower end plate 160S is not expanded to the side of the second bolt hole 138-2, and the bulging portion 171S is extended to the outside of the lower discharge chamber concave portion 163S. Accordingly, as illustrated in FIG. 6, the first bulging portion 171S1 is extended from the lower discharge chamber concave portion 163S along the circumferential direction of the rotary shaft 15 toward the second bolt hole 138-2 on the plane orthogonal to the rotary shaft 15, and accordingly has a bottom portion 171*b* that is opposed to a lower surface 160*a* outside the lower discharge chamber concave portion 163S in the lower end plate 160S.

It is preferable that the spatial volume (A−B) of the lower end plate cover chamber 180S be between 30% and 39% inclusive of the total excluded volume C. Because of the volume ratio [(A−B)/C]×100[%] between 30% and 39% inclusive, an effect of reducing noise of the rotary compressor 1 can be obtained significantly, and an effect of increasing efficiency of the rotary compressor 1 is obtained significantly. Particularly when the volume ratio [(A−B)/C]×100[%] is equal to or larger than 40%, because the effect of increasing efficiency of the rotary compressor 1 starts decreasing, it is not preferable.

TABLE 1

| Model | Total excluded volume (cc) | Volume of lower discharge valve housing concave portion (cc) | Volume of bulging portion (cc) | Spatial volume (cc) | (Spatial volume/total excluded volume) × 100 |
|---|---|---|---|---|---|
| a | 13.00 | 3.18 | 0 | 3.18 | 24 |
| b | 15.00 | 3.18 | 0 | 3.18 | 21 |
| c | 19.89 | 3.36 | 3.70 | 7.06 | 35 |
| d | 25.00 | 3.36 | 3.70 | 7.06 | 28 |
| e | 25.00 | 4.45 | 2.21 | 6.66 | 27 |
| f | 30.00 | 4.45 | 2.21 | 6.66 | 22 |

Table 1 presents specific configuration examples corresponding to the present embodiment. The above-described volume ratio [(A−B)/C]×100[%] of each of the rotary compressors 1 of models a to fin Table 1 meets volume ratio between 20% and 40% inclusive.

Noise Level

Figure 9:
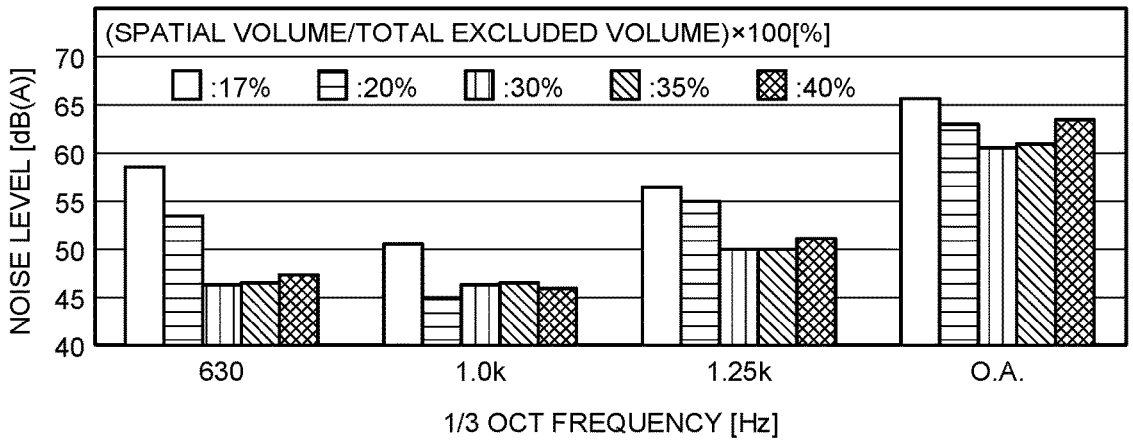
FIG. 9 is a graph for explaining the relationship between the volume ratio and the noise level in the embodiment.

FIG. 9 is a graph for explaining the relationship between the volume ratio [(A−B)/C]×100[%] and the noise level [dB(A)] in the embodiment. FIG. 9 presents, with respect to the volume ratio [(A−B)/C]×100[%], 17% serving as a comparative example and 20%, 30%, 35% and 40% serving as the embodiment in comparison. FIG. 9 presents, with respect to each of the volume ratios [(A−B)/C]×100[%], each noise level [dB(A)] and each frequency [Hz] (every frequency inclusive (O.A. (overall value) represented together) in the case of ⅓ octave on [dB/octave (OCT)] in comparison. Note that FIG. 9 has measurement results in the case where the total excluded volume C is 20[cc] and the rotation speed of the motor 11 is 80 [rps].

As illustrated in FIG. 9, according to the embodiment, because the volume ratio [(A−B)/C]×100[Vo] meets a volume ratio between 20% and 40% inclusive, it is possible to reduce the noise level. The embodiment makes it possible to effectively reduce the noise level of a low frequency band around 630 [Hz] particularly.

Cooling Period Efficiency

Figure 10:
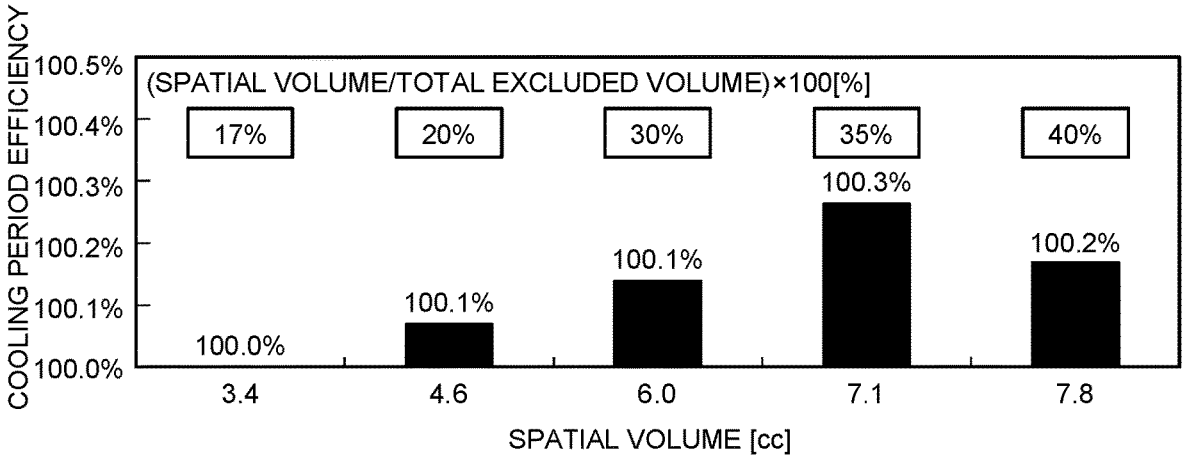
FIG. 10 is a graph for explaining the relationship between the volume ratio and the cooling period efficiency in the embodiment.

FIG. 10 is a graph for explaining the relationship between the volume ratio [(A−B)/C]×100[Vo] and the cooling period efficiency in the embodiment. As FIG. 9 does, FIG. 10 presents, with respect to the volume ratio [(A−B)/C]×100 [%], 17% serving as a comparative example and 20%, 30%, 35% and 40% serving as the embodiment in comparison. FIG. 10 presents, with respect to each of the volume ratios [(A−B)/C]×100[%], each period efficiency and each spatial volume (A−B) [cc] in comparison. Note that FIG. 10 has measurement results in the case where the total excluded volume C is 20 [cc] and the output (amount of heat) is 30000 BTU (British Thermal Unit).

As illustrated in FIG. 10, according to the embodiment, the cooling period efficiency is increased compared to the comparative example in which the cooling period efficiency is 100.00%. The embodiment makes it possible to effectively increase the cooling period efficiency particularly when the volume ratio [(A−B)/C]×100[%] is around 35%.

Effect of Embodiment

As described above, when the bulging portion 171S of the lower end plate cover 170S in the rotary compressor 1 of the embodiment is divided along the first straight line L1, connecting the center O of the rotary shaft 15 and the center of the first bolt hole 138-1, into the first bulging portion 171S1, which is positioned on the side of the second bolt hole 138-2, and the second bulging portion 171S2, which is positioned on the side of the third bolt hole 138-3, on the plane orthogonal to the axial direction of the rotary shaft 15, the first bulging portion 171S1 is larger than the second bulging portion 171S2. This makes the volume of the bulging portion 171S appropriate, and the pressure pulsation is suppressed, and accordingly it is possible to increase efficiency of the rotary compressor 1 and suppresses the pressure pulsation in the lower end plate cover chamber 180S. Therefore, it is possible to realize both improvement in energy consumption efficiency (performance coefficient/COP: Coefficient Of Performance) in a freezing cycle using the rotary compressor 1 and suppression of vibrations of the rotary compressor 1.

In addition to this, according to the rotary compressor 1 of the embodiment, it is possible to increase the volume of the bulging portion 171S appropriately and ensure the spatial volume (A−B) of the lower end plate cover chamber 180S appropriately, and it is possible to reduce noise of the rotary compressor 1. Furthermore, according to the rotary compressor 1, because the bulging portion 171S is extended in the direction orthogonal to the axial direction of the rotary shaft 15, and accordingly the depth of the bulging portion 171S of the lower end plate cover 170S is suppressed from increasing, it is possible to ensure mechanical strength of the bulging portion 171S appropriately and suppress workability of the bulging portion 171S.

The first bulging portion 171S1 of the lower end plate cover 170S in the rotary compressor 1 of the embodiment, is extended from the lower discharge chamber concave portion 163S along the circumferential direction of the rotary shaft 15 toward the second bolt hole 138-2, and has the bottom portion 171*b*, which is opposed to the lower surface 160*a* outside the lower discharge chamber concave portion 163S in the lower end plate 160S. In other words, because the lower discharge chamber concave portion 163S of the lower end plate 160S is not expanded to the side of the second bolt hole 138-2, and the first bulging portion 171S1 is expanded to the side of the second bolt hole 138-2, the spatial volume is ensured appropriately. As described above, avoiding expansion of the lower discharge chamber concave portion 163S makes it possible to appropriately ensure the mechanical strength of the lower end plate 160S, reduce a heating loss caused because the refrigerant gas, which is sucked into the lower cylinder chamber 130S, is heated by the heat of the refrigerant gas in the lower discharge chamber concave portion 163S, and increase the efficiency of the rotary compressor 1.

The bulging portion 171S of the lower end plate cover 170S in the rotary compressor 1 of the embodiment makes contact with the lower surface of the lower end plate 160S throughout the peripheral portion 171*a* of the bulging portion 171S. Thus, because the bulging portion 171S does not have a portion, extending over the sub bearing 161S, leakage of the refrigerant gas from the lower end plate cover chamber 180S due to variation in the shape of the bulging portion 171S and the shape of the sub bearing 161S, is suppressed, and air tightness in the bulging portion 171S is increased.

In the rotary compressor 1 of the embodiment, when a total volume obtained by summing volumes of the lower discharge chamber concave portion 163S, the lower discharge valve housing concave portion 164S, and the bulging portion 171S is set as A, a total volume obtained by summing volumes that the lower discharge valve 200S, the lower discharge valve cap 201S, and the lower rivet 202S occupy in the lower discharge chamber concave portion 163S and the lower discharge valve housing concave portion 164S is set as B, and a total excluded volume obtained by summing excluded volumes of the upper compression chamber 133T and the lower compression chamber 133S is set as C, the spatial volume (A−B) of the lower end plate cover chamber 180S is between 20[%] and 40[%] inclusive of the total excluded volume C. Thus, it is possible to reduce noise of the rotary compressor 1 and reduce noise of a low frequency band particularly, and it is possible to increase efficiency of the rotary compressor 1.

In the rotary compressor 1 of the embodiment, the spatial volume (A−B) of the lower end plate cover chamber 180S is between 30[%] and 39[%] inclusive of the total excluded volume C. This makes it possible to reduce noise of the rotary compressor 1 effectively and increase efficiency of the rotary compressor 1 effectively.

REFERENCE SIGNS LIST

1 ROTARY COMPRESSOR
10 COMPRESSOR HOUSING
11 MOTOR
12 COMPRESSION UNIT
15 ROTARY SHAFT
104 LOWER SUCTION PIPE (SUCTION UNIT)
135S LOWER SUCTION HOLE (SUCTION HOLE)
107 DISCHARGE PIPE (DISCHARGE UNIT)
121T UPPER CYLINDER
121S LOWER CYLINDER
125T UPPER PISTON
125S LOWER PISTON
127T UPPER VANE
1275 LOWER VANE
128T UPPER VANE GROOVE
128S LOWER VANE GROOVE
130T UPPER CYLINDER CHAMBER
130S LOWER CYLINDER CHAMBER
131T UPPER SUCTION CHAMBER

131S LOWER SUCTION CHAMBER
133T UPPER COMPRESSION CHAMBER
133S LOWER COMPRESSION CHAMBER
136 REFRIGERANT PATH HOLE
138 BOLT HOLE
138-1 FIRST BOLT HOLE
138-2 SECOND BOLT HOLE
138-3 THIRD BOLT HOLE
140 INTERMEDIATE PARTITION PLATE
160T UPPER END PLATE
160S LOWER END PLATE
160*a* LOWER SURFACE
163T UPPER DISCHARGE CHAMBER CONCAVE PORTION
163S LOWER DISCHARGE CHAMBER CONCAVE PORTION
164T UPPER DISCHARGE VALVE HOUSING CONCAVE PORTION
164S LOWER DISCHARGE VALVE HOUSING CONCAVE PORTION
170S LOWER END PLATE COVER
171S BULGING PORTION
171S1 FIRST BULGING PORTION
171S2 SECOND BULGING PORTION
171*a* PERIPHERAL PORTION
171*b* BOTTOM PORTION
174, 175 THROUGH BOLT
180T UPPER END PLATE COVER CHAMBER
180S LOWER END PLATE COVER CHAMBER
190T UPPER DISCHARGE HOLE
190S LOWER DISCHARGE HOLE
200T UPPER DISCHARGE VALVE
200S LOWER DISCHARGE VALVE
200*a* PROXIMAL END PORTION
200*b* DISTAL END PORTION
201S LOWER DISCHARGE VALVE CAP
202S LOWER RIVET
D CENTER LINE OF LOWER SUCTION HOLE
L1 FIRST STRAIGHT LINE
L2 SECOND STRAIGHT LINE
O CENTER OF ROTARY SHAFT
M1, M2 INNER CIRCUMFERENTIAL SIDE LENGTH

The invention claimed is:

1. A rotary compressor comprising: a compressor housing that is cylindrical and in which a refrigerant discharge unit is provided in an upper part and a refrigerant suction unit is provided in a lower part, the compressor housing being sealed; a compression unit that is arranged in the compressor housing, that compresses a refrigerant, which is sucked from the suction unit, and that discharges the refrigerant from the discharge unit; and a motor that is arranged in the compressor housing and that drives the compression unit, the compression unit including an upper cylinder, which is annular, and a lower cylinder, which is annular; an upper end plate that closes an upper side of the upper cylinder; a lower end plate that closes a lower side of the lower cylinder; an intermediate partition plate that is arranged between the upper cylinder and the lower cylinder and that closes a lower side of the upper cylinder and an upper side of the lower cylinder; a rotary shaft that is supported by a main bearing, provided in the upper end plate, and a sub bearing, provided in the lower end plate, and that is rotated by the motor; an upper eccentricity unit and a lower eccentricity unit that are provided in the rotary shaft with a phase difference; an upper piston that is provided in the upper eccentricity unit, that revolves along an inner circumferential surface of the upper cylinder, and that forms an upper cylinder chamber in the upper cylinder; a lower piston that is provided in the lower eccentricity unit, that revolves along an inner circumferential surface of the lower cylinder, and that forms a lower cylinder chamber in the lower cylinder; an upper vane that protrudes from an upper vane groove, provided in the upper cylinder, into the upper cylinder chamber, that makes contact with the upper piston, and that divides the upper cylinder chamber into an upper suction chamber and an upper compression chamber; a lower vane that protrudes from a lower vane groove, provided in the lower cylinder, into the lower cylinder chamber, that makes contact with the lower piston, and that divides the lower cylinder chamber into a lower suction chamber and a lower compression chamber; an upper end plate cover that covers the upper end plate, that forms an upper end plate cover chamber between the upper end plate cover and the upper end plate, and that has an upper end cover discharge hole connecting the upper end plate cover chamber and inside of the compressor housing; a lower end plate cover that covers the lower end plate and that forms a lower end plate cover chamber between the lower end plate cover and the lower end plate; an upper discharge hole that is provided in the upper end plate and that connects the upper compression chamber and the upper end plate cover chamber; a lower discharge hole that is provided in the lower end plate and that connects the lower compression chamber and the lower end plate cover chamber; a refrigerant path hole that penetrates the lower end plate, the lower cylinder, the intermediate partition plate, the upper end plate, and the upper cylinder and that connects the lower end plate cover chamber and the upper end plate cover chamber; a plurality of bolt holes that penetrate the lower end plate cover and that are provided on a same circumference in an outer edge part of the lower end plate cover; and a plurality of through bolts that are inserted into the bolt holes from a side of the lower end plate cover and that fastens the lower end plate cover to the lower cylinder, wherein the lower end plate includes a lower discharge valve in a form of a reed valve whose proximal end portion is fixed to the lower end plate and whose proximal end portion opens and closes the lower discharge hole; a lower discharge valve housing concave portion that is extended in a form of a groove from the lower discharge hole and in which the lower discharge valve is housed; and a lower discharge chamber concave portion that is formed such that the lower discharge chamber concave portion overlaps the discharge valve housing concave portion on a side of the lower discharge hole and that connects to the refrigerant path hole, the lower end plate cover is formed into a plate shape and is provided with a bulging portion having a portion opposed to the lower discharge hole, the lower end plate cover chamber is formed of the lower discharge valve housing concave portion, the lower discharge chamber concave portion, and the bulging portion, in a circumferential direction of the rotary shaft, the bolt holes includes a first bolt hole, which is arranged between the distal end portion and the proximal end portion of the lower discharge valve, a second bolt hole, which is arranged in a position adjacent to the first bolt hole on a side close to the lower vane groove with respect to the first bolt hole, and a third bolt hole, which is arranged in a position adjacent to the first bolt hole on a side away from the lower vane groove with respect to the first bolt hole, and when the bulging portion of the lower end plate cover is divided into a first bulging portion, which is positioned on a side of the second bolt hole, and a second bulging portion, which is positioned on a side of the third bolt hole, on a plane orthogonal to the axial direction of the rotary shaft, using a first straight line connecting a center of the rotary shaft and a center of the first bolt hole, the first bulging portion is larger than the second bulging portion.

2. The rotary compressor according to claim 1, wherein an inner circumferential side length of the first bulging portion, which extends along the circumferential direction of the rotary shaft from the first straight line to an end of the bulging portion on an inner circumferential side, is larger than an inner circumferential side length of the second bulging portion.

3. The rotary compressor according to claim 1, wherein the suction unit includes a suction hole that is provided in the lower cylinder and that extends in a radial direction of the rotary shaft, and the first bulging portion extends to an area between a center line of the suction hole, passing through the center O of the rotary shaft, and a second straight line connecting the center of the rotary shaft and a center of the second bolt hole, on the plane orthogonal to the axial direction of the rotary shaft.

4. The rotary compressor according to claim 1, wherein the first bulging portion is extended toward the second bolt hole along the circumferential direction of the rotary shaft from the lower discharge chamber concave portion, and has a bottom portion that is opposed to a lower surface outside the lower discharge chamber concave portion in the lower end plate.

5. The rotary compressor according to claim 1, wherein, on the plane orthogonal to the axial direction of the rotary shaft, a width of the bulging portion with respect to a radial direction of the rotary shaft is at minimum on the first straight line.

6. The rotary compressor according to claim 1, wherein the bulging portion of the lower plate cover makes contact with a lower surface of the lower end throughout the peripheral portion of the bulging portion.

7. The rotary compressor according to claim 1, wherein the lower end plate includes a lower discharge valve cap that is provided in a layered manner on the lower discharge valve and that regulates opening of the lower discharge valve, and a lower rivet that fixes the proximal end portion of the lower discharge valve to the lower end plate, and the lower discharge valve cap and the lower rivet are arranged in the lower discharge valve housing concave portion, and when a total volume obtained by summing volumes of the lower discharge chamber concave portion, the lower discharge valve housing concave portion, and the bulging portion is set as A, a total volume obtained by summing volumes that the lower discharge valve, the lower discharge valve cap, and the lower rivet occupy in the lower discharge chamber concave portion and the lower discharge valve housing concave portion is set as B, and a total excluded volume, which is obtained by summing excluded volumes of the upper compression chamber and the lower compression chamber, is set as C, the spatial volume (A−B) of the lower end plate cover chamber is between 20% and 40% inclusive of the total excluded volume C.

8. The rotary compressor according to claim 7, wherein the spatial volume (A−B) of the lower end plate cover chamber is between 30% and 39% inclusive of the total excluded volume C.

* * * * *